United States Patent [19]

d'Hautefeuille

[11] Patent Number: 4,567,843

[45] Date of Patent: Feb. 4, 1986

[54] MOORING SYSTEM

[75] Inventor: Benoit B. d'Hautefeuille, Nice, France

[73] Assignee: Single Buoy Moorings, Inc., Fribourg, Switzerland

[21] Appl. No.: 658,801

[22] Filed: Oct. 9, 1984

Related U.S. Application Data

[63] Continuation of Ser. No. 301,192, Sep. 11, 1982, abandoned.

[30] Foreign Application Priority Data

Sep. 12, 1980 [NL] Netherlands ..... 8005142

[51] Int. Cl.[4] ..... B63B 21/00

[52] U.S. Cl. ..... 114/230; 441/3

[58] Field of Search ..... 405/202; 114/230; 441/3-5

[56] References Cited

U.S. PATENT DOCUMENTS

| | | | |
|---|---|---|---|
| 2,894,268 | 7/1959 | Griebe | 441/5 X |
| 3,360,810 | 1/1968 | Busking | 114/230 |
| 3,407,768 | 10/1968 | Graham | 441/5 X |
| 3,605,668 | 9/1971 | Morgan | 441/3 |
| 3,620,181 | 11/1971 | Naczkowski | 441/3 X |
| 3,641,602 | 2/1972 | Flory et al. | 441/5 |
| 3,677,302 | 7/1972 | Morgan | 441/3 |
| 3,982,401 | 9/1976 | Loggins | 175/7 |
| 4,031,582 | 6/1977 | van Heijst | 441/3 |
| 4,069,529 | 1/1978 | van Heijst | 441/5 |
| 4,170,186 | 10/1979 | Shaw | 114/264 |
| 4,193,368 | 3/1980 | DeGraaf | 114/230 X |
| 4,262,380 | 4/1981 | Foolen | 114/230 |
| 4,279,047 | 7/1981 | van Heijst | 441/5 |
| 4,299,262 | 11/1981 | Andrepont | 441/5 X |
| 4,326,312 | 4/1982 | Tang | 441/5 |
| 4,371,037 | 2/1983 | Arnaudeau | 114/230 X |

FOREIGN PATENT DOCUMENTS

| | | | |
|---|---|---|---|
| 1418802 | 10/1965 | France . | |
| 2303702 | 10/1976 | France . | |
| 2427943 | 1/1980 | France . | |
| 1384983 | 2/1975 | United Kingdom | 441/5 |
| 1497518 | 1/1978 | United Kingdom . | |

*Primary Examiner*—Sherman D. Basinger

*Attorney, Agent, or Firm*—Young & Thompson

[57] ABSTRACT

A mooring system comprising a vessel (1) floating on the water surface, such as a ship, and having an arm structure (2) pivotally secured to it. A buoyant body (9) presses upwardly on the arm structure (2); and the end of the arm structure opposite the ship is pivotally connected to a connector (4-6) that extends generally vertically upward from a bottom anchor (7). The connector (4-6) is maintained under tensile stress by the buoyancy of buoyant body (9). A number of anchor chains (10) are attached to the connector (4-6) and extend down to the sea bottom in various directions and are anchored to the sea bottom at a distance from the anchor (7) to which the connector (4-6) is attached. These anchor chains (10) exert a tensile force on the connector (4-6) in the opposite direction from the force exerted by the buoyant body (9).

7 Claims, 12 Drawing Figures

MOORING SYSTEM

This application is a continuation of application Ser. No. 301,192, filed Sept. 11, 1982, and now abandoned.

The invention relates to a mooring system comprising a vessel floating on the water surface, such as a ship, which vessel is attached by means of an arm structure secured to the vessel for pivotal movement about a horizontally extending axis to the upper end of a connecting means extending substantially vertically upwards from a bottom anchor, with respect to which connecting means said arm structure can swing at least around a vertical axis. The connecting means is maintained under tensile stress by means of a buoyant body such that said connecting means tries to maintain its upwardly directed position.

BACKGROUND OF THE INVENTION

Such a mooring system is generally known and examples thereof are described in report OTC 3567 "THE MOORING OF A TANKER TO A SINGLE POINT MOORING BY A RIGID YOKE" presented at the 11th annual OTC Conference in Houston, Apr. 30–May 3, 1979, especially FIGS. 3,5 and 6. Said known mooring systems are based on the principle that the connecting means, maintained under tensile stress by means of the buoyant body, exposed after a movement from the central position to a horizontal force component which increases as the deviation from the central position increases, and which is derived from the force upwardly exerted by means of the buoyant body on the connecting means. When the buoyant body is not completely submerged the deviation will furthermore result in an increased water displacement so that the upwardly directed force and therewith the horizontal return component increases. Said mooring systems are relatively simple and stable systems as a result of the mutual cooperation between the vessel, floating on the water surface, the rigid pivotable arm structure and the buoyant body. Said buoyant body may form a part of the connecting means, however it can also be a float which is firmly attached to the rigid pivotable arm structure.

Besides this known system there is also a still older system comprising a buoy having means for connecting a ship thereto, which buoy is kept in place by means of anchor chains extending in different directions in diverging relationship and attached to the sea bottom. Such a system is for instance illustrated in FIG. 2 of the above mentioned OTC 3567 report. This older system is based on the principle that after displacement of the buoy the weight of one or more of said chains generates a return force which in said respective chains is larger than the forces exerted on the buoy by the other chains, so that the buoy is brought back to the original central position.

In great depths problems arise. When one has to take into account heavy storms and great depths of a few hundred meters, then for anchoring said buoy by means of chains one has to use chains having a weight which will be out of all proportion and the handling of which becomes impossible.

If the system with a connecting means tensioned by means of buoyancy is used, then for greater depths one has to use bodies with a large buoyancy to have sufficient force to create a usable horizontal return component at a small deviation from the vertical position. That means however, that in the connecting means impermissible stresses can be developed, whereas in heavy weather conditions unacceptable situations can arise in which the connecting means is overloaded and there is a risk that the vessel may deviate too far from the desired position without being sufficiently returned.

An object of the invention is to offer a solution for said problem.

SUMMARY OF THE INVENTION

Said object is attained according to the invention in that a plurality of anchor chains or other tension means, extending in different directions, are attached to said connecting means, which anchor chains or other tension means are fastened at a distance from the bottom anchor and exert a tensile force on said connecting means which is opposite to the tension exerted by said buoyant body. Thus the invention is substantially based on a combination of an anchoring system using the floating capacity and an anchoring system based on the gravity force principle. When the system according the invention is in the balanced position, then the horizontal components of the forces exerted by the anchor chains will balance each other. The vertical components of said forces act opposite to the upwardly directed force resulting from the buoyancy of the connecting means itself or of a separate buoyant body, which in most cases is attached to the arm structure. Said vertical load of the connecting means decreases the value of the vertical upwardly directed force which is exerted on said connecting means by the buoyant body, from which upward force the horizontal return component has to be derived. Thus, the chains with their vertical force component decrease the vertical upwardly directed force acting on the connecting means so that a lighter construction can be used for it. Said decrease also results in a decrease of the horizontal return component derived from the upwardly directed force of the buoyancy, when a displacement occurs tending to deflect the connecting means from its vertical position. However in case of such a displacement one or more of the chains will immediately generate a horizontal return force.

It is now surprising, that with the system according to the invention a total return force can be obtained which is larger than in case one of the two known systems is used separately, whereas simultaneously the tensile stress in the connecting means can be maintained within acceptable limits and the weights of the chains can still be handled. Thus, said chains can be of a lighter construction than if they have to carry out the return function alone, the connecting structure has to take up less tension and can therefore be constructed much simpler whereas both together generate a relatively large return force.

Furthermore it is more important that the chain connections, i.e. the means to which the chains are fastened, are positioned above the water level. That simplifies maintenance and inspection.

When the chains are fastened as high as possible, then they generate also the largest possible horizontal return force. On the other hand by a suitable choice of the point where the chains are attached to the connecting means, which is not necessarily the highest point, but can be a point at a lower level, the bending moments in the connecting means are reduced.

It is necessary that the chains do not come into contact with other parts of the mooring system, for instance a buoyant body attached to the arm structure.

Many variations of the mooring system according to the invention are conceivable in that the arm structure can have its own buoyancy or not, in combination with a connecting means consisting of a rigid body, having its own buoyancy or not, means comprising a number of parts having their own buoyancy or not, a chain which can be combined with a buoyant body, or consisting of parts which have themselves so much buoyancy, that the chain is weightless.

Which combination or which type one will use depends on the circumstances.

When the connecting means comprises two parts coupled to each other by means of a universal joint, as known per se, then the mooring chains can be attached to the lower part, especially when said lower part is buoyant. Of course it is possible to connect the chains to the upper part and it is also possible to connect the chains to both parts. When there are more, then two parts than if necessary all parts can be provided with chains.

The connecting structure can be formed in several ways. It can consist of a chain which itself has no buoyancy. It also can consist of a rigid pipe which at the lower end and at the upper end is connected by means of universal pivot connections or universal pivot joints.

It is however also possible to use a tower having buoyancy or a weightless chain. In the latter case a smaller buoyant body connected to the arm structure will suffice.

Thus, the chains or tension means can be attached at any suitable level or at a number of levels. They can be attached symmetrically in relation to the connecting means, and the symmetry can be different for each level. They also can be attached asymmetrically. The attaching positions can be chosen such that the most favourable compromise is reached in relation to the desired return capacity and the reduction of bending moments which are generated under the influence of wave forces and the anchored ship.

BRIEF DESCRIPTION OF THE DRAWINGS

The invention will now be explained in more detail with reference to the attached drawings.

DETAILED DESCRIPTION OF THE INVENTION

Figure 1:
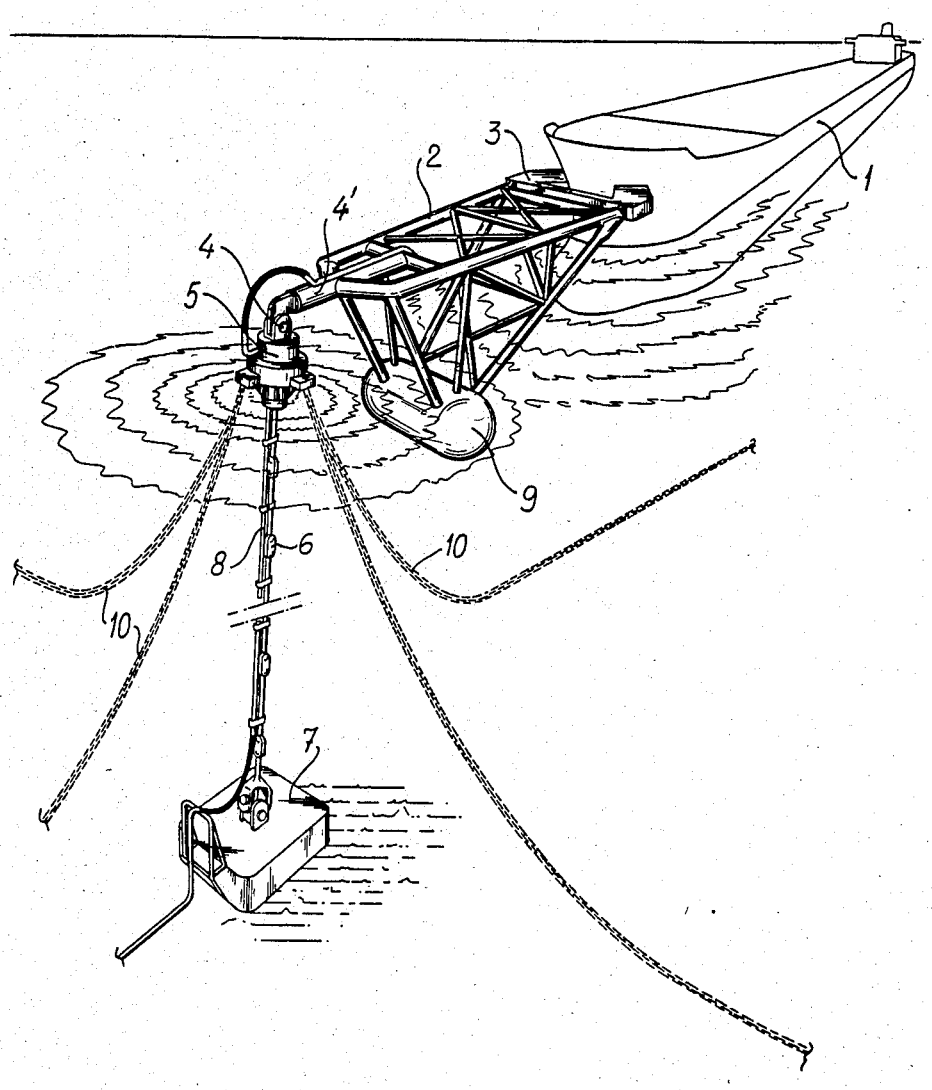
FIG. 1 illustrates an embodiment wherein the arm structure is buoyant.

FIG. 1 shows a mooring system comprising a tanker 1, a connecting arm structure 2, which at 3 is connected to the tanker for pivotal movement around a horizontal axis and which has at 4 and 4' a joint with two mutually perpendicular horizontal pivot axes and a vertical pivot connection at the side of the conduit connection 5, which connections are positioned at the upper end of the chain 6 forming the connecting means with the anchor 7, along which chain one or more conduits 8 can be extend. The arm structure 2 comprises a buoyant body 9 which is always totally submerged and maintains a tensile stress in the chain 6.

At the upper end of the connecting means or chain 6, chains 10 are mounted extending in different directions to not illustrated anchors on the bottom of the sea.

When the system is displaced such that the chain 6 is not extending vertically anymore, then the tensile stress in the chain 6 resulting from the buoyancy of the body 9 produces a return force, whereas simultaneously one or more chains 10 produce an additional return force.

Figure 2:
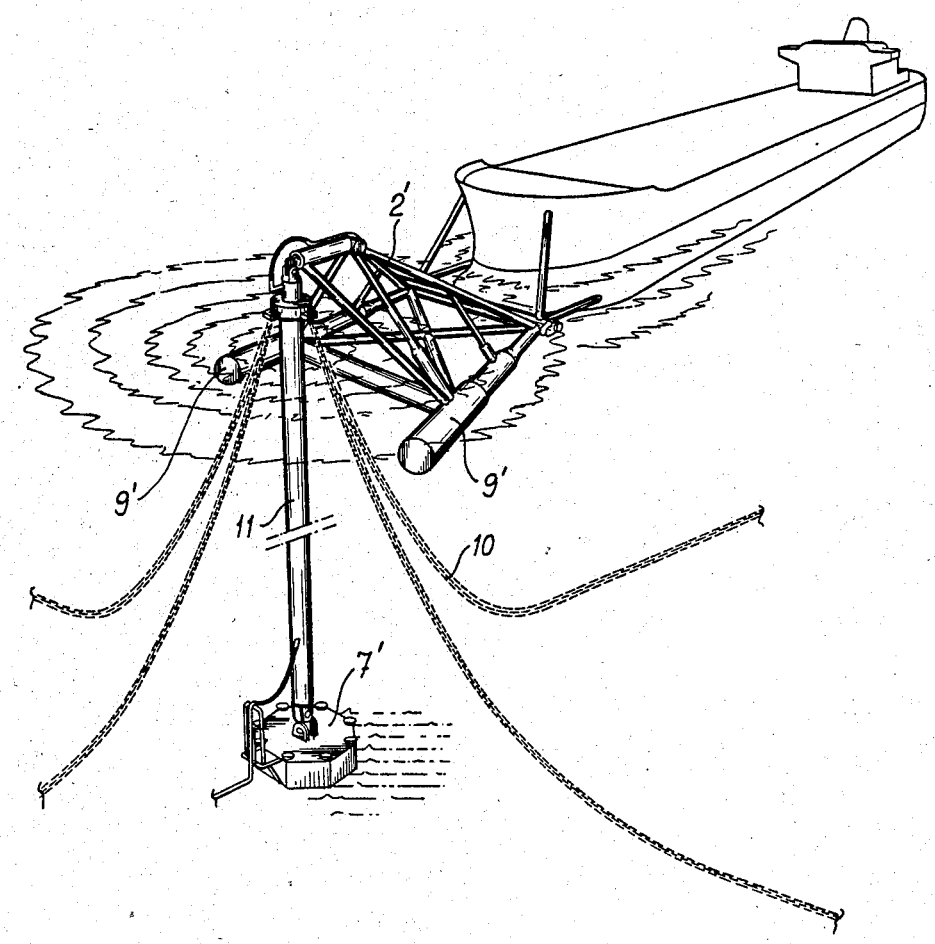
FIG. 2 illustrates an embodiment in which the arm structure and the connecting means are buoyant.

FIG. 2 corresponds substantially to FIG. 1 however with the difference, that besides the buoyant bodies 9' mounted on the connecting arm structure 2' also the connecting means 11, consisting of a rigid pipe, has a certain buoyancy which pipe is connected to the anchor 7' and to the arm structure 2' via universal joints. In this embodiment all the conduits extend through the pipe 11.

The chains 10 are connected in the same way as shown in FIG. 1. Because of the bifurcated shape of the buoyant body having buoyant tanks 9' collisions between said buoyant tanks and the rigid connecting means 11 or the chains 10 can be prevented.

Figure 3:
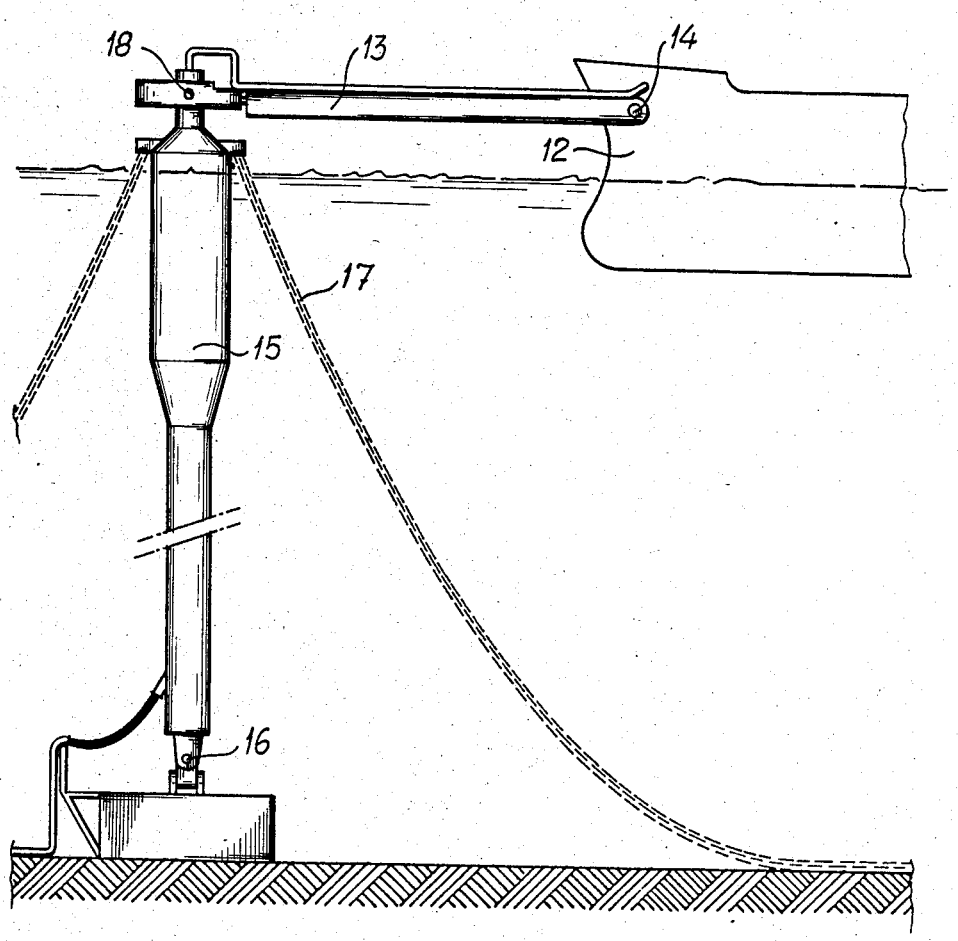
FIG. 3 illustrates an embodiment in which only the connecting means is buoyant.

FIG. 3 illustrates an embodiment comprising a tanker 12 which through an arm structure 13 having a horizontal pivot connection 14, is coupled to the connecting means in the form of a tower 15, which by means of a universal joint 16 is connected to the anchor and has at the upper end three mutually perpendicularly extending pivot axes incorporated in the universal joint 18. Said pivotable tower is buoyant, especially the enlarged upper part thereof to which the anchor chains 17 are connected.

Figure 4:
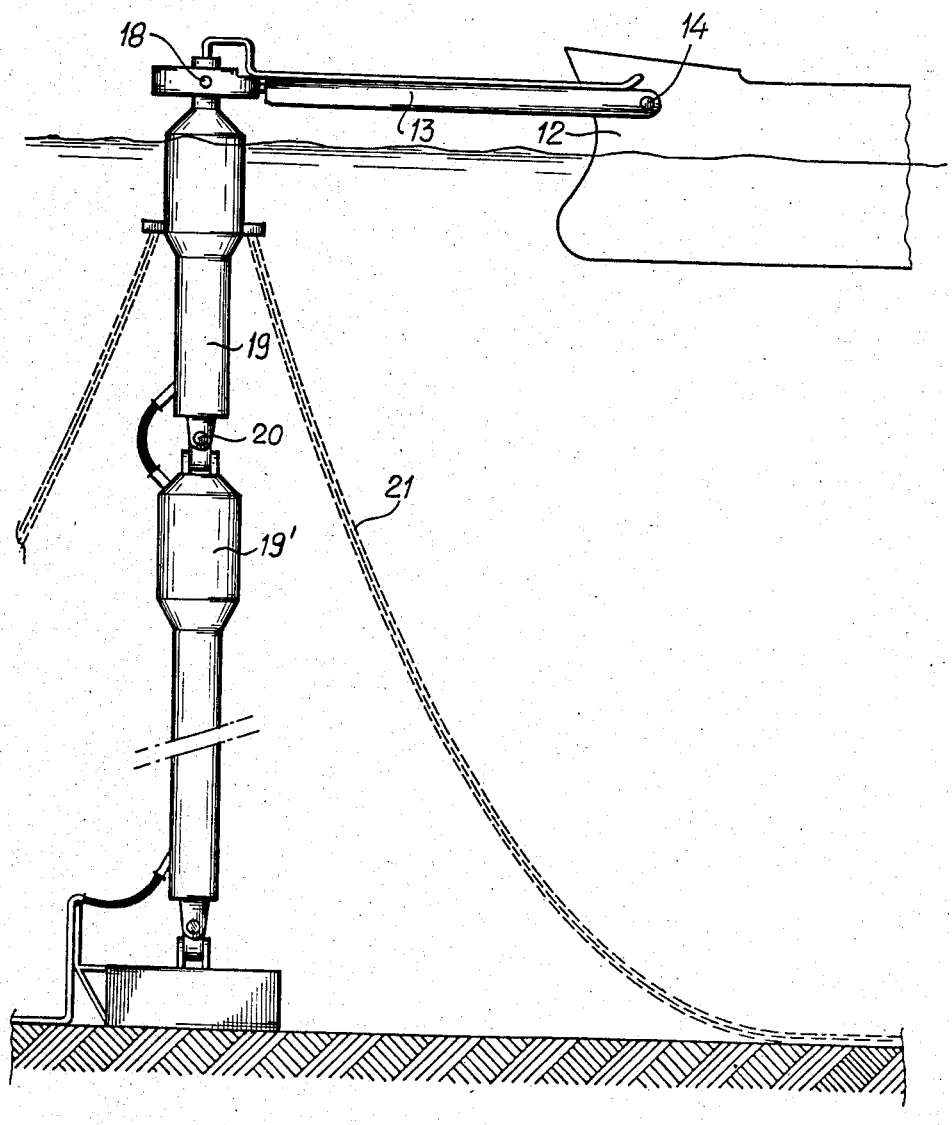
FIG. 4 illustrates an embodiment with buoyancy in the connecting means, which is divided into two parts, coupled by means of a universal joint for decreasing the bending moments.

In the embodiment of FIG. 4 the tower comprises two parts 19 and 19' both having buoyancy in their upper sections, which parts are mutually connected via a universal joint 20. Because of this universal joint the bending moments in the tower are significantly reduced. The anchor chains 21 are connected to the upper end at a level which is positioned as favorably as possible in relation to the load of the whole structure.

Figure 5:
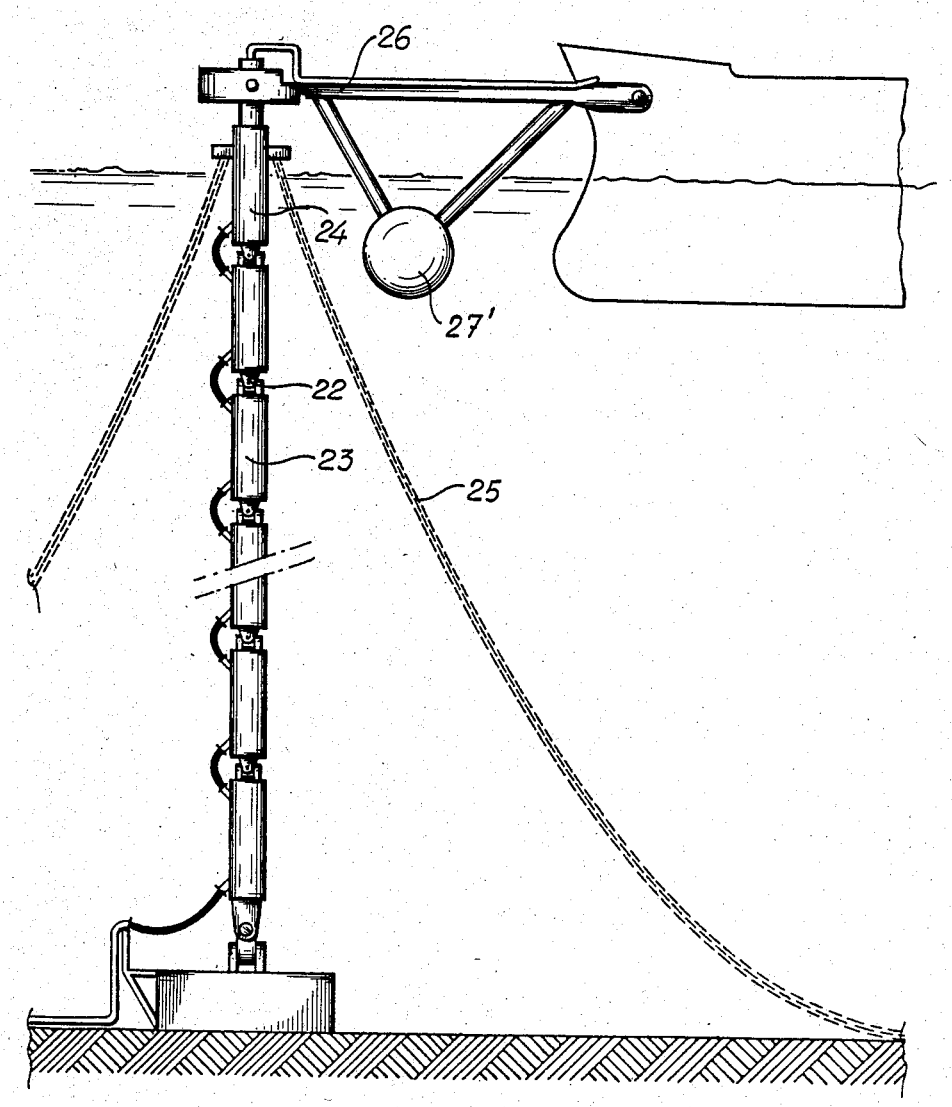
FIG. 5 illustrates a further embodiment in which the arm structure has buoyancy and in which the connecting means has little buoyancy.

The principal difference between FIG. 1 and the embodiment of FIG. 5 is that the connecting means comprises a chain of bodies 23 coupled to each other by means of pivot connections or universal joints 22, which bodies are buoyant such that in water they form a weightless chain whereby the size of the buoyant tank 27' can be reduced. The result thereof is that lower dynamic loads set on the mooring system as a whole.

In this embodiment the chains 25 are connected to the upper part 24 of the connecting means. The connection between this upper part 24 and the arm structure 26 may be realized by means of a universal pivot joint, a pivot element having a vertical and a horizontal axis, or a pivot joint having only a vertical axis.

Figure 6:
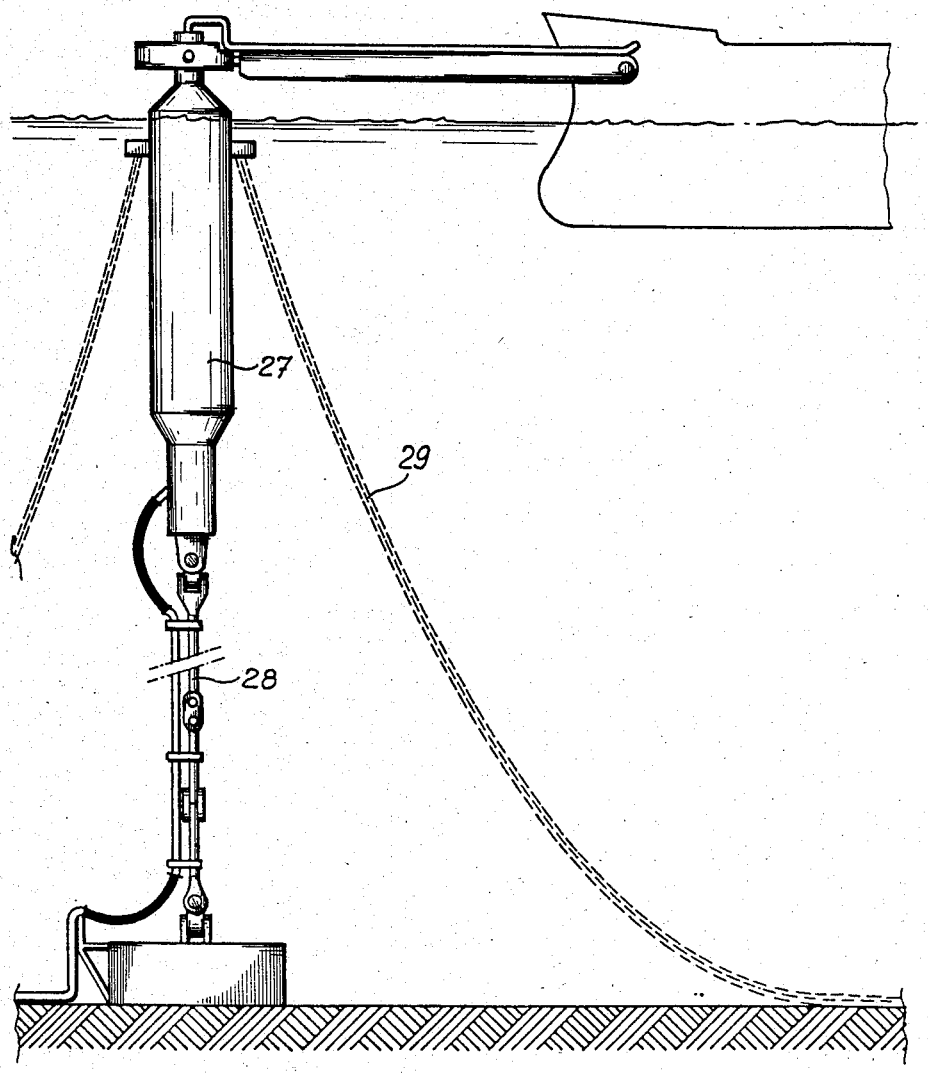
FIG. 6 illustrates an embodiment in which the upper part of the connecting means has buoyancy.

The embodiment of FIG. 6 is a variant of the embodiment illustrated in FIG. 4 and has connecting means consisting of a buoyant cylinder 27 and a chain 28. The chains 29 are connected to the cylindrical body 27 at such a height, that the horizontal return force is maximum at a predetermined displacement of the ship.

Figure 7:
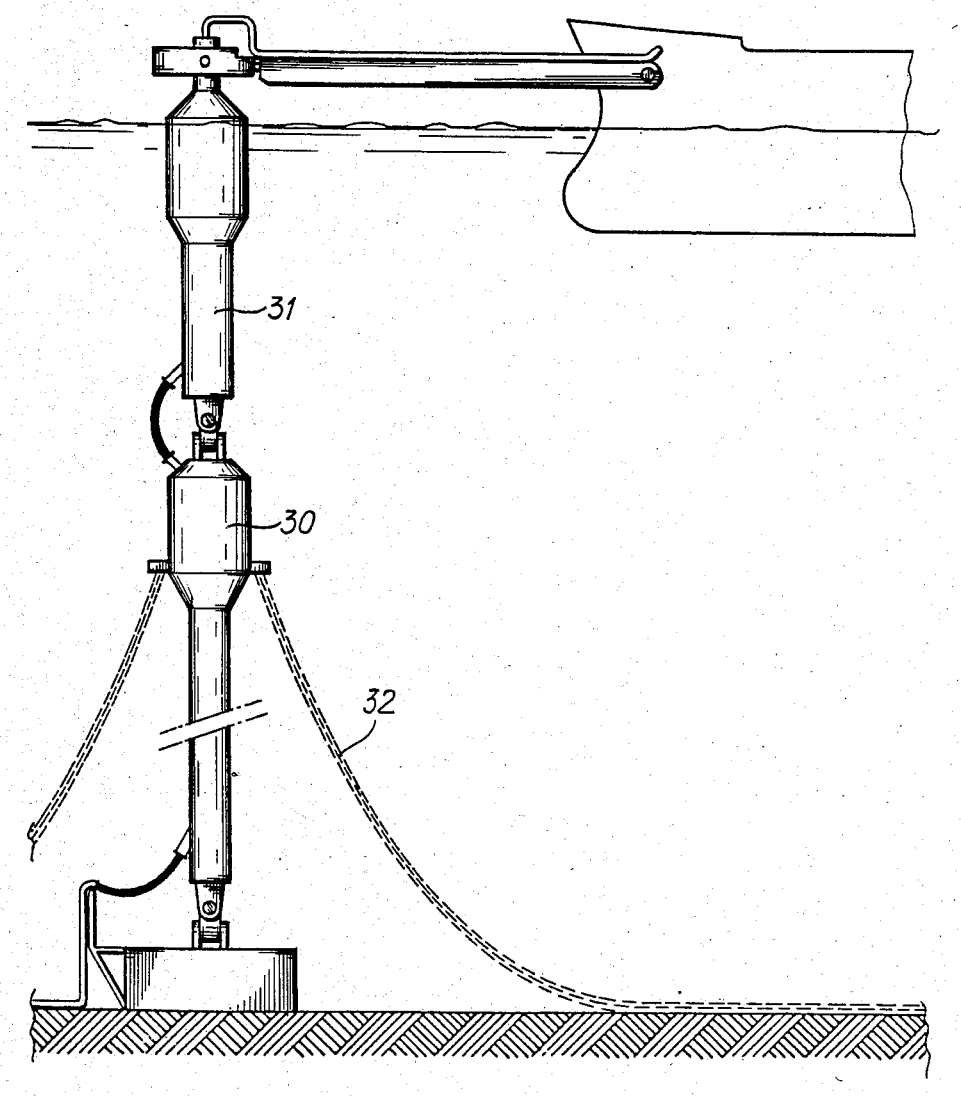
FIG. 7 illustrates the same embodiment of the connecting means as in FIG. 4, but in this case chains are connected to the lower part thereof.

The embodiment illustrated in FIG. 7 comprises connecting means which, similarly to the means shown in FIG. 4, are divided into two parts 30 and 31, however only the lower part 30 is coupled to the anchor chains 32. Therefore the combined function is obtained only in the lower part, whereas the return force is delivered in the upper part by the buoyancy of said upper part.

Figure 8:
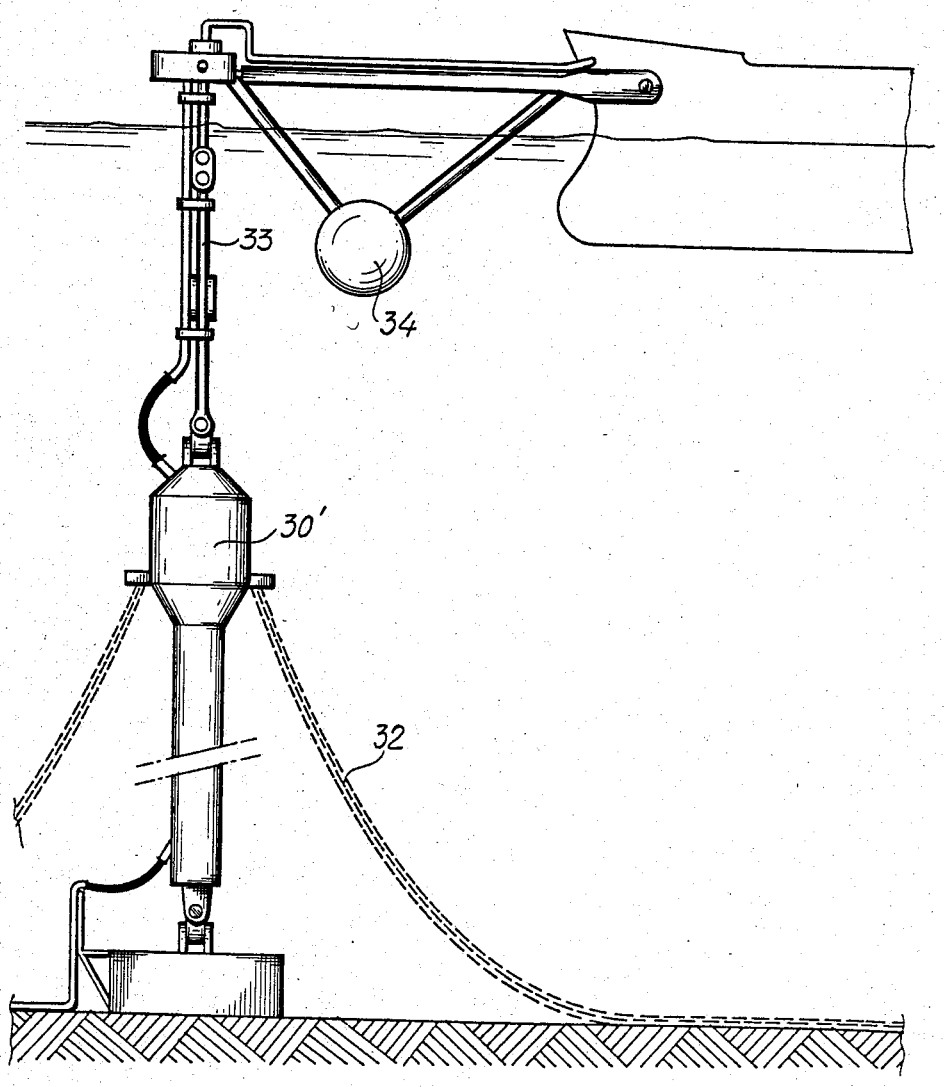
FIG. 8 illustrates an embodiment with buoyancy in the arm structure and in the lower part of the connecting means to which the chains are attached.

The embodiment of FIG. 8 is a combination of the system with a buoyant body 34 in the arm structure as illustrated in FIG. 1, and the system with a buoyant body 30' in the vertical connecting means as is illustrated in FIG. 7. In this embodiment the lower part 30' is connected to the chains 32. Therefore the combined function is obtained in this lower part whereas the buoyant body 34 acts on the upper part and indirectly also on the lower part.

Figure 9:
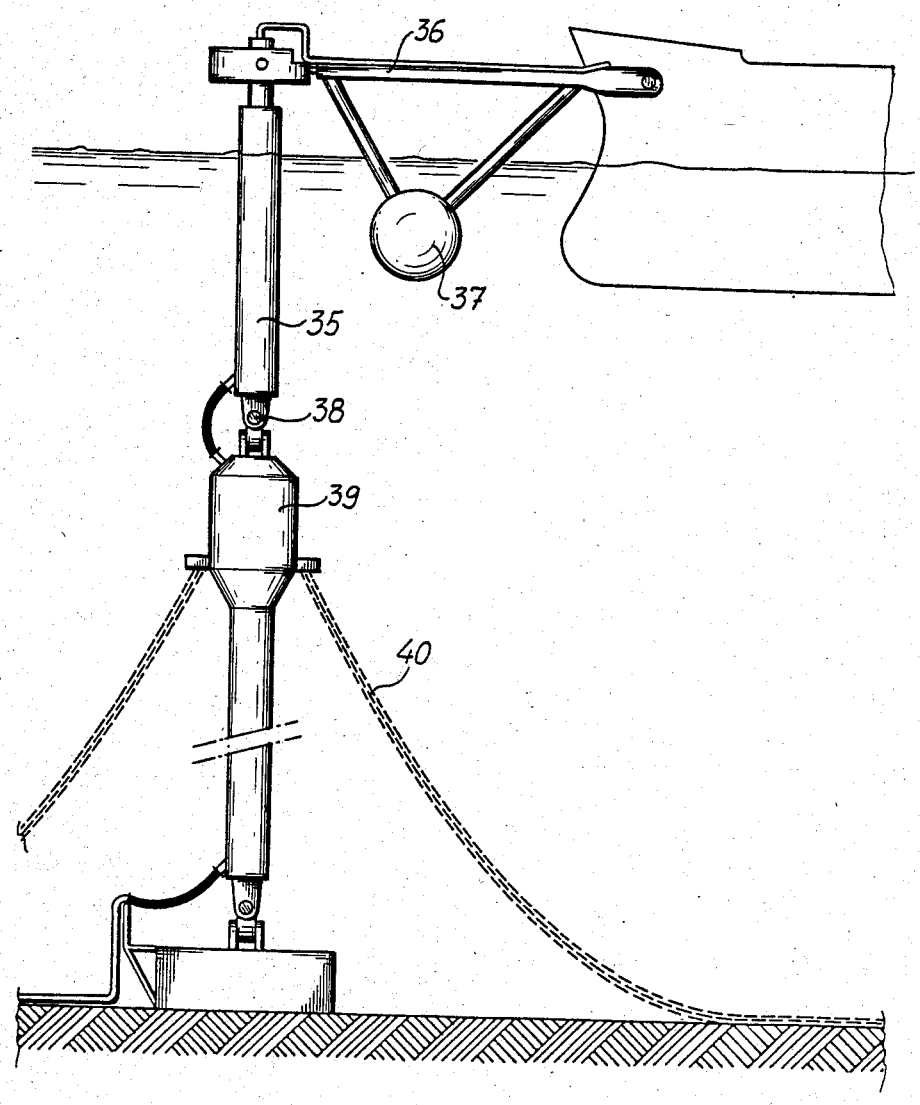
FIG. 9 illustrates again an embodiment in which the whole connecting means, divided into two parts, as well as the arm structure has buoyancy, and furthermore chains are attached to the lower part of the connecting means.

The embodiment illustrated in FIG. 9 differs from the embodiment illustrated in FIG. 8 in that the upper part 35 of the connecting means is formed as a rigid pipe having a universal pivot connection to the arm structure 376 carrying the buoyant body 37.

Figure 10:
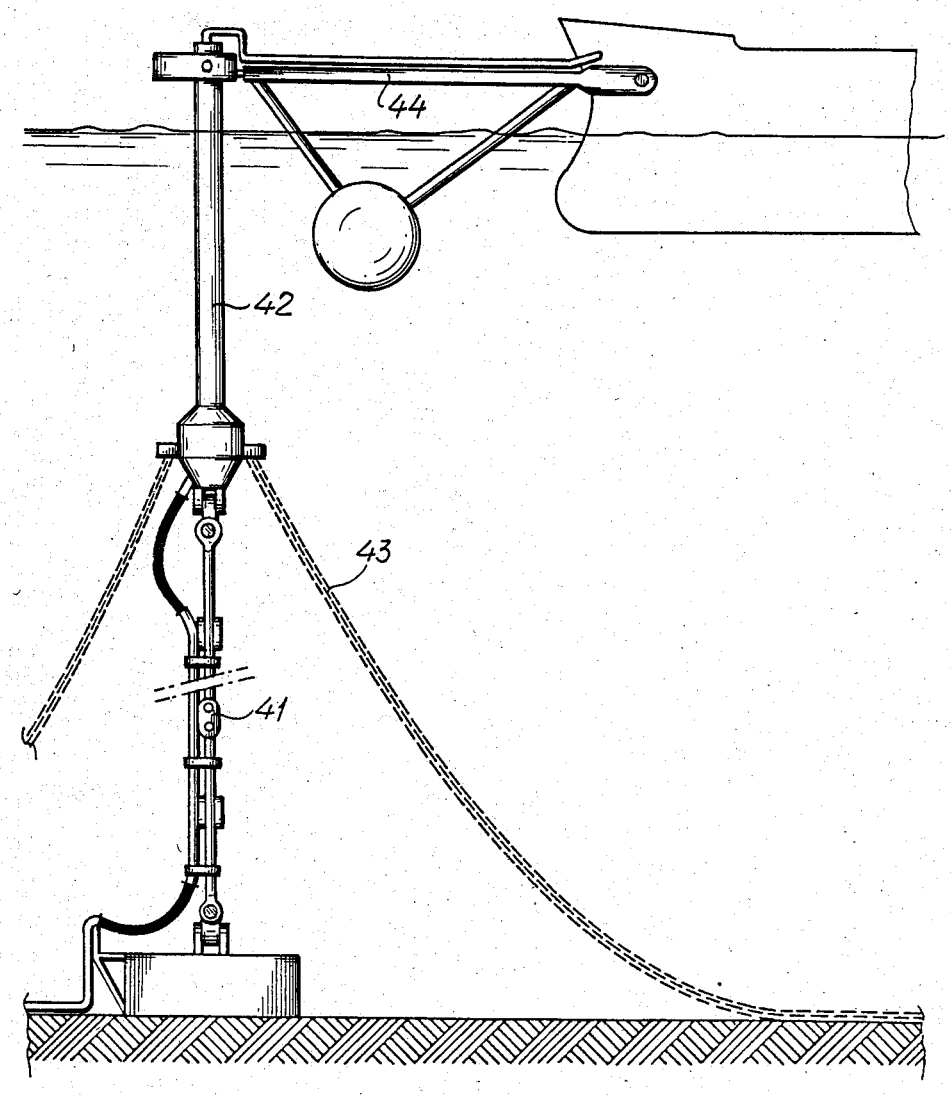
FIG. 10 illustrates an embodiment in which the arm structure has buoyancy and the upper part of the connecting means has buoyancy, chains being attached at the lower end thereof.

In contrast therewith the lower section of the connecting structure of the embodiment illustrated in FIG. 10 is formed as a chain 41 and the upper part 42 is coupled at its lower end to the anchor chains 43.

Figure 11:
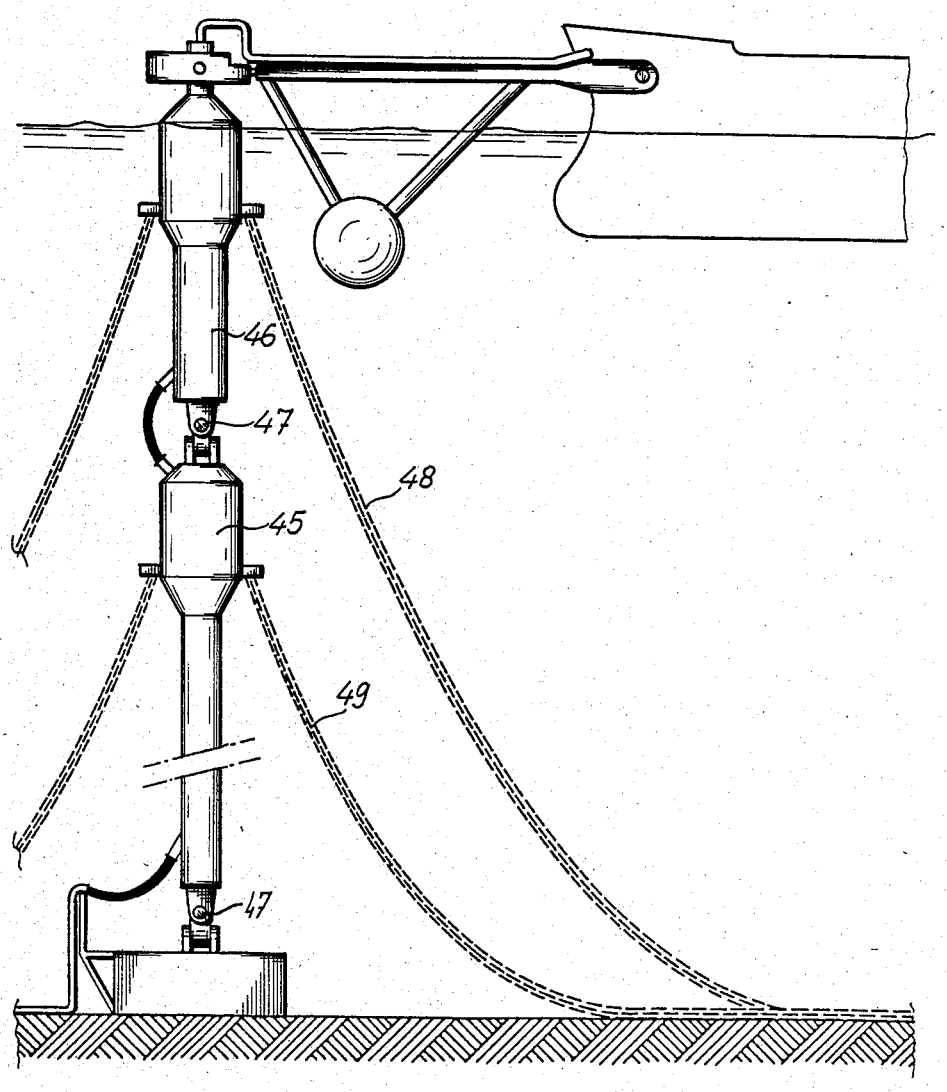
FIG. 11 shows an embodiment in which the arm structure has buoyancy, the connecting means comprises two parts having buoyancy in both parts and to both parts chains are attached.

In the embodiment illustrated in FIG. 11 the connecting means comprises in the same way as shown in FIG. 7 a lower part 45 and an upper part 46, connected to each other and to the anchor by means of universal joints 47 and connected to the arm structure by means of a universal pivot joint. In this embodiment the two parts have respective anchor chains 48 and 49.

Figure 12:
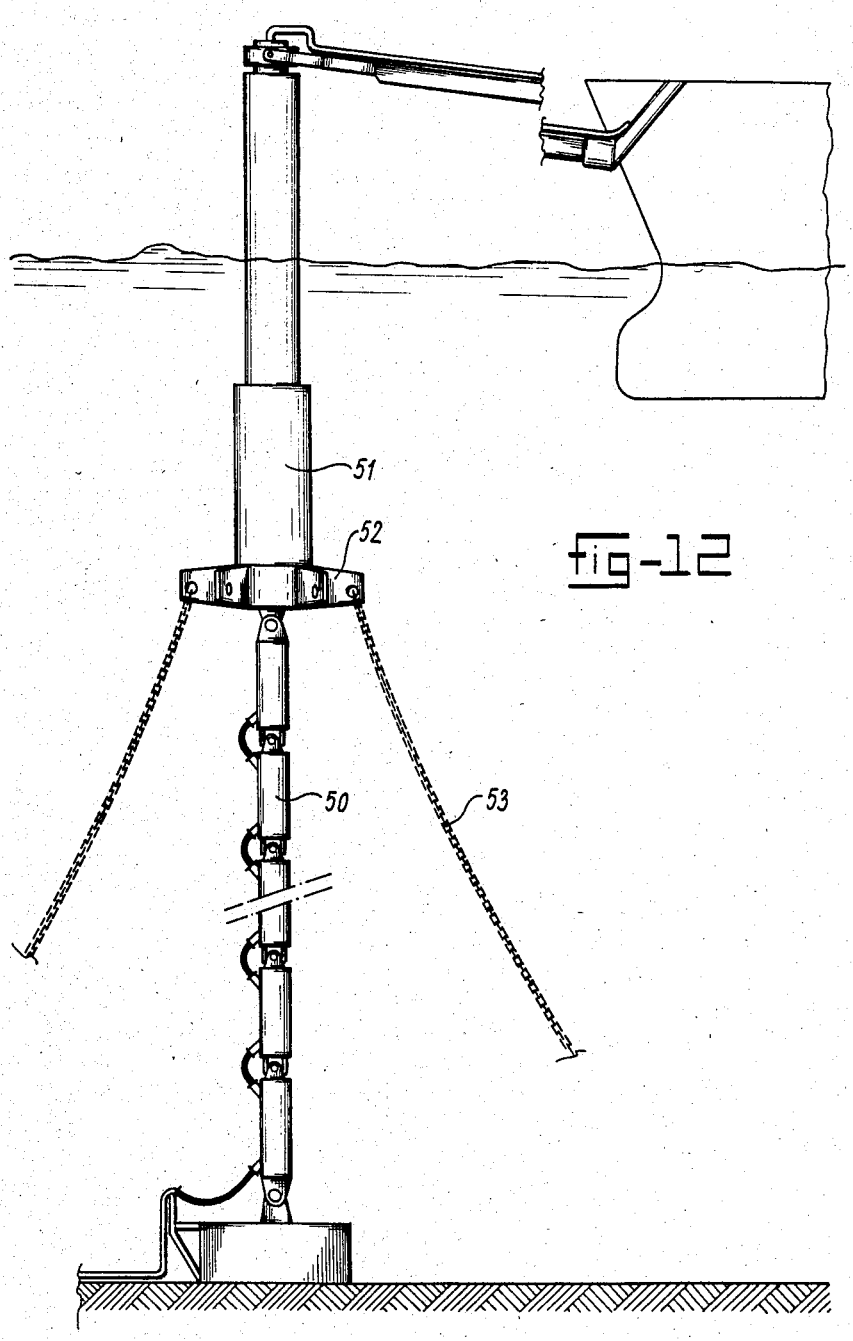
FIG. 12 illustrates an embodiment having a connecting means comprising a chain with buoyancy and a buoy on top of said chain, at the lower end of which chains are connected.

In the embodiment of FIG. 12 the lower part of the connecting means is formed as a weightless chain 50, of the same type as illustrated in FIG. 5, whereas the upper part is formed as a vertical buoy or float with radially extending arms 52 near the lower end thereof, to which the anchor chains 53 are connected. When the chains are connected at a level deep under the water level, then these chains are not exposed to the influence of waves.

Connecting the chains at different levels and to different parts of the vertical connecting means is possible in all the above discussed embodiments.

In case of storms always coming from the same direction, the chains can be connected asymmetrically to the vertical connecting means and/or can have mutually different pre-streses. In case more parts of the connecting means are provided with anchor chains then the chains from different parts can extend symmetrically in different directions or the anchor chains of the one part can be attached symmetrically and those of the other part can be attached asymmetrically. It is furthermore possible to realize the same or a mutually different asymmetrical configuration for the different parts. Therefore, the prevailing circumstances and the swinging movements to which the various parts of the connecting structure are together and separately exposed, are important.

However in all embodiments it is possible to obtain with a combination of a relatively light connecting means and relatively light chains or other tension means a larger return force than can be obtained with one or both separately. In this way a mooring system is realized which is also suitable for greater depths.

Instead of anchor chains also cables can be used, even elastic cables and instead of weights the tension in the anchor means, such as the cables, can be imposed by means of buoyant bodies.

I claim:

1. In a mooring system in water of great depth of a few hundred meters, comprising a vessel floating on the water surface, which vessel is attached by means of an arm structure secured to the vessel for pivotal movement about a horizontally extending axis to the upper end of a connecting means extending substantially vertically upward from a bottom anchor, with respect to which connecting means said arm structure can swing at least around a vertical axis, which connecting means is maintained under tensile stress by means of a buoyant body such that said connecting means tries to maintain its upwardly directed position; the improvement comprising a plurality of anchor chains extending in different directions, directly and fixedly attached to said connecting means, and fastened at a distance from the bottom anchor and exerting a force on said connecting means which is opposite to the tension exerted by said buoyant body thereby to reduce the tension exerted by said buoyant body between said bottom anchor and the point of connection of said chains to said connecting means.

2. Mooring system according to claim 1, in which the anchor chains are attached to said connecting means adjacent the upper end thereof.

3. Mooring system according to claim 1, in which the connecting means comprises two parts coupled to each other by means of a universal pivot joint, the anchor chains being connected to the upper end of the lower part.

4. Mooring system according to claim 1, in which the connecting means comprises two parts coupled to each other by means of a universal pivot joint, the anchor chains being connected to the lower end of the upper part.

5. Mooring system according to claim 1, in which the connecting means comprises at least two parts coupled to each other by means of universal pivot joints, the anchor chains being attached to all said parts.

6. Mooring system according to claim 1, in which the anchor chains are asymmetrically attached to the connecting structure.

7. Mooring system according to claim 1, in which the anchor chains have mutually different pre-stresses.

* * * * *